US012528006B2

(12) United States Patent
Sun

(10) Patent No.: US 12,528,006 B2
(45) Date of Patent: Jan. 20, 2026

(54) SUPPORT STRUCTURE FOR TRAMPOLINE SAFETY NET

(71) Applicant: Hui Sun, Jiangsu (CN)

(72) Inventor: Hui Sun, Jiangsu (CN)

( * ) Notice: Subject to any disclaimer, the term of this patent is extended or adjusted under 35 U.S.C. 154(b) by 181 days.

(21) Appl. No.: 18/351,269

(22) Filed: Jul. 12, 2023

(65) Prior Publication Data

US 2024/0408473 A1 Dec. 12, 2024

(30) Foreign Application Priority Data

Jun. 12, 2023 (CN) ..... 202321491470.3

(51) Int. Cl.
*A63B 5/11* (2006.01)
*A63B 71/02* (2006.01)

(52) U.S. Cl.
CPC ..... *A63B 71/022* (2013.01); *A63B 5/11* (2013.01)

(58) Field of Classification Search
CPC ..... A63B 71/022; A63B 5/11
See application file for complete search history.

(56) References Cited

U.S. PATENT DOCUMENTS

| | | | | |
|---|---|---|---|---|
| 5,941,798 | A * | 8/1999 | Coan | A63B 5/11 482/28 |
| 6,237,169 | B1 | 5/2001 | Ying | |
| 8,012,066 | B1 * | 9/2011 | Hsiang | A63B 71/022 |
| 9,486,691 | B1 * | 11/2016 | McGee | A63B 71/022 |
| 9,689,519 | B2 | 6/2017 | Hsiang | |
| 10,549,136 | B2 | 2/2020 | Hsiang | |
| 10,758,763 | B1 * | 9/2020 | Chen | A63G 9/00 |
| 10,786,697 | B2 | 9/2020 | Liu | |
| 2008/0269021 | A1 * | 10/2008 | Publicover | A63B 5/11 482/29 |
| 2018/0256931 | A1 * | 9/2018 | Chen | F16F 1/26 |
| 2018/0290000 | A1 * | 10/2018 | Chen | A63B 71/022 |
| 2020/0384338 | A1 * | 12/2020 | Chen | A63B 71/023 |

FOREIGN PATENT DOCUMENTS

| | | | | |
|---|---|---|---|---|
| EP | 3466496 | A1 * | 4/2019 | A63B 5/11 |
| FR | 3050644 | A1 * | 11/2017 | A63B 5/11 |
| WO | WO-2019207269 | A1 * | 10/2019 | A63B 5/11 |

* cited by examiner

*Primary Examiner* — Nyca T Nguyen

(57) ABSTRACT

The present disclosure provides a support structure for a trampoline safety net, including: a plurality of fence poles mounted upwards on edges of a trampoline main body; a plurality of connecting strips, capable of penetrating through the fence poles along a length direction perpendicular to the fence poles; and a connecting piece, fixedly connecting adjacent two of the connecting strips. The structure is simple and convenient to mount, and edges of the safety net will not collapse.

3 Claims, 6 Drawing Sheets

SUPPORT STRUCTURE FOR TRAMPOLINE SAFETY NET

TECHNICAL FIELD

The present disclosure relates to the technical field of trampolines, in particular to a support structure for a trampoline safety net.

BACKGROUND

Trampolines can be used as fitness and entertainment equipment, which is deeply loved by young people and children. Some trampolines are provided with safety nets. A plurality of fence poles are vertically arranged on a trampoline main body and fixed to edges of a safety net. Most of the safety nets are made of soft, thin and light materials. The edge of the safety net between two fence poles will collapse due to being fixed and not tightened, resulting in reduced protective performance of the safety net. In addition, due to small contact area of joints between the fence poles and the safety net, the capability of bearing external tearing force is weak, and thus the safety net is prone to damage. A hard ring connection structure is arranged on the edges of an upper end of the safety net, which can effectively solve the problem of edge collapse of the safety net. However, the fence poles and the hard ring connection structure are complex, inconvenient to connect, and cumbersome to mount, use and store, bringing poor usage experience to users.

SUMMARY

An objective of the present disclosure is to provide a support structure for a trampoline safety net. The structure is simple and convenient to mount, and edges of the safety net will not collapse.

To achieve the above objective, the present disclosure provides the following technical solution:

A support structure for a trampoline safety net is provided, including: a plurality of fence poles, arranged vertically upwards and at intervals, where a bottom of each of the fence poles is mounted on an edge of a trampoline main body; a plurality of connecting strips, capable of penetrating through the fence poles along a length direction perpendicular to the fence poles, where the fence poles are capable of restricting the movement of the connecting strips; and a connecting piece, fixedly connecting adjacent two of the connecting strips.

Further, an opening is provided from an upper part to a top of each of the fence poles, and each of the connecting strips is capable of penetrating through a corresponding one of the fence poles through the opening.

Further, a top of each of the fence poles is further sleeved with a cover cap, the cover cap being sleeved at the top of the fence pole and wrapping a tube wall of the fence pole therein.

Further, a composite inner cover is arranged inside the cover cap, the composite inner cover having an outer diameter smaller than an inner diameter of the fence pole and an inner diameter greater than an outer diameter of the fence pole, and when the fence pole is covered by the cover cap, the tube wall of the fence pole is wrapped between the composite inner cover and the cover cap.

Further, the connecting piece is of a square tube structure, each of the connecting strips is of a square connecting strip structure, and a section size of the connecting strip is matched with a section size of an inner side of a square tube of the connecting piece, such that when the connecting strip is inserted into the connecting piece, the connecting strip is in clearance fit with the connecting piece.

Further, first limiting spring pieces are arranged on side walls of each of the connecting pieces, clamping grooves are arranged at end portions of each of the connecting strips and matched with the first limiting spring pieces, and when the connecting strip is inserted into the connecting piece, the first limiting spring pieces are in clamped connection with the clamping grooves.

Further, the first limiting spring pieces are arranged on the side walls of two ends of each of the connecting pieces, respectively, and correspondingly, the clamping grooves are arranged at two ends of each of the connecting strips, respectively. In another aspect, another type of fence poles are provided, a through hole penetrating through each of the fence poles is arranged at an upper part of the fence pole, and each of the connecting strips is capable of penetrating through a side wall of the fence pole via the through hole.

In another aspect, another connection between the connecting pieces and the connecting strips is provided, a first connecting hole is arranged at an end portion of each of the connecting pieces, correspondingly, a second connecting hole matched with the first connecting hole is arranged at an end portion of each of the connecting strips, and the connecting strip and the connecting piece are fixedly connected by a pin or a bolt between the first connecting hole and the second connecting hole.

In another aspect, another connection between the connecting pieces and the connecting strips is provided, an end portion of each of the connecting pieces is fixed to an end portion of one end of each of the connecting strips to form an integrated structure.

Further, a first limiting spring piece is arranged at one end of each of the connecting pieces, the other end of the connecting piece is fixed to one end of a corresponding one of the connecting strips to form an integrated structure, a clamping groove matched with the first limiting spring piece is arranged at the other end of the corresponding connecting strip, and during connection, the corresponding connecting strip is in clamped connection with the first limiting spring piece of the connecting piece at the other end of another connecting strip.

Further, a first connecting hole is arranged at one end of each of the connecting pieces, the other end of the connecting piece is fixed to one end of a corresponding one of the connecting strips to form an integrated structure, a second connecting hole matched with the first connecting hole is arranged at the other end of the corresponding connecting strip, and the corresponding connecting strip and the connecting piece are fixedly connected by a pin or a bolt between the first connecting hole and the second connecting hole. In another aspect, another connection between the connecting pieces and the connecting strips is provided, a first limiting spring piece is arranged at one end of each of the connecting pieces, a first connecting hole is arranged at the other end of the connecting piece, correspondingly, a clamping groove matched with the first limiting spring piece is arranged at one end of each of the connecting strips, a second connecting hole matched with the first connecting hole is arranged at the other end of the connecting strip, one end of the connecting strip is in clamped connection with the first limiting spring piece by the clamping groove, and the second connecting hole at the other end of the connecting strip is fixedly connected to the first connecting hole of the connecting piece by a pin or a bolt.

In another aspect, another connection between the connecting pieces and the connecting strips is provided, communicating grooves are arranged at two ends of each of the connecting pieces, respectively, spring plates are mounted on side surfaces of the connecting piece, second limiting spring pieces are arranged at positions, corresponding to the two communicating grooves, of the spring plates, clamping grooves matched with the second limiting spring pieces are arranged at two ends of each of the connecting strips, respectively, and the second limiting spring pieces extend into the communicating grooves and cooperate with the clamping grooves to clamp the connecting strip.

In another aspect, another connection between the connecting pieces and the connecting strips is provided, first mounting holes are arranged on side walls, provided with the communicating grooves, of each of the connecting pieces, second mounting holes are arranged at positions, corresponding to the first mounting holes, of the spring plates, and pins or bolts are arranged in the first mounting holes and the second mounting holes to fixedly connect the spring plates to the connecting piece.

In another aspect, another connection between the connecting pieces and the connecting strips is provided, a dismounting hole is arranged at the other end of each of the connecting pieces, a clamping plate with one fixed end is arranged inside the dismounting hole, a clamping key is arranged on an inner side of a free end of the clamping plate, correspondingly, a clamping groove matched with the clamping key is arranged at the other end of each of the connecting strips, and a size of the dismounting hole is greater than a size of the clamping plate, which facilitates an operator to use a tool to extend into the dismounting hole and then lift up the free end of the clamping plate to remove the clamped connection between the clamping key and the clamping groove. It can be seen from analysis that the present disclosure provides a support structure for a trampoline safety net, the structure is simple and convenient to mount, and edges of the safety net will not collapse.

The technical solution of the present disclosure lowers the difficulty of operation, greatly shortens replacement time and reduces work intensity, and saves costs.

BRIEF DESCRIPTION OF THE DRAWINGS

The accompanying drawings, forming part of the present application, serve to provide a further understanding for the present disclosure, and the exemplary embodiments of the present disclosure as well as the illustrations thereof serve to explain the present disclosure and do not constitute an undue limitation of the present disclosure. In the drawings.

DESCRIPTION OF REFERENCE NUMBERS

Figure 1:
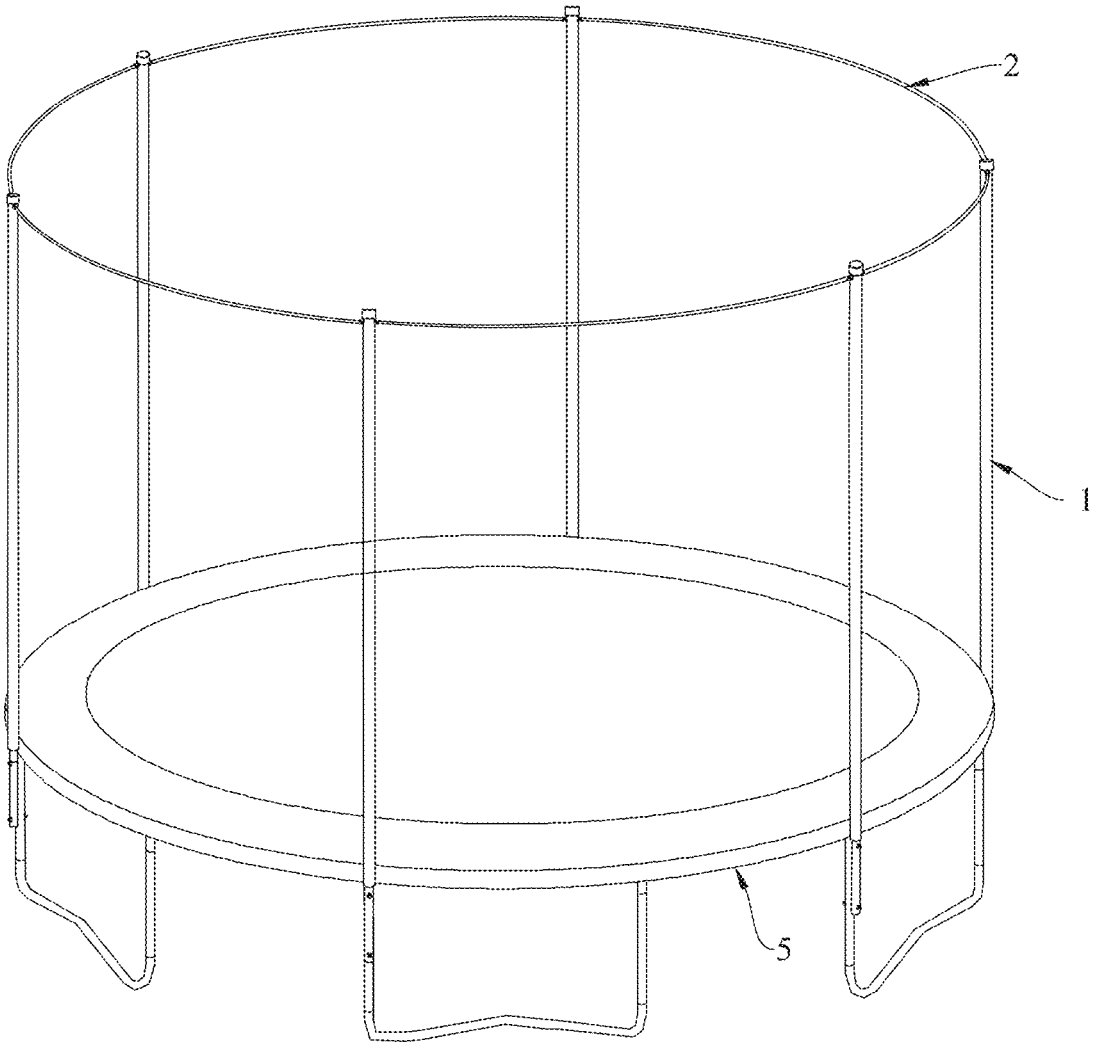
FIG. 1 is a schematic state diagram of mounting a top ring connecting structure of a safety net on a trampoline.

1—fence pole; 11—opening; 12—inner plug; 13—cover cap; 130—composite inner cover; 14—through hole; 2—connecting strip; 21—clamping groove; 22—second connecting hole; 3—connecting piece; 31—first limiting spring piece; 32—first connecting hole; 33—first mounting hole; 34—communicating groove; 35—dismounting hole; 36—clamping plate; 37—clamping key; 4—spring plate; 41—second mounting hole; 42—second limiting spring piece; and 5—trampoline main body.

DESCRIPTION OF THE EMBODIMENTS

The present disclosure will be described in detail below with reference to the accompanying drawings and in conjunction with embodiments. Various examples are provided by way of interpretation of the present disclosure and not limiting the present disclosure. Indeed, it will be apparent to those skilled in the art that modifications and variations may be made in the present disclosure without departing from the scope or spirit of the present disclosure. For example, features shown or described as part of one embodiment may be used in another embodiment to produce yet another embodiment. It is therefore desirable that the present disclosure encompasses such modifications and variations falling within the scope of the appended claims and their equivalents.

In the description of the present disclosure, the terms "longitudinal", "transverse", "up", "down", "front", "back", "left", "right", "vertical", "horizontal", "top", "bottom" and the like denote orientations or positional relationships based on those shown in the drawings, are intended for ease of description of the present disclosure only and not to require that the present disclosure must be constructed and operated in a particular orientation, and therefore cannot be construed as a limitation to the present disclosure. The terms "connected", "connection" and "arranged" used in the present disclosure should be understood in a broad sense, for example, which may refer to a fixed connection or a detachable connection; which may refer to a direct connection or an indirect connection through an intermediate component; which may refer to a wired electrical connection, a radio connection, or a wireless communication signal connection, and the specific meanings of the above terms may be understood by those of ordinary skill in the art according to a specific situation.

One or more examples of the present disclosure are shown in the accompanying drawings. The detailed description uses numeric and alphabetic markers to refer to features in the drawings. Similar or like reference signs in the drawings and descriptions have been used to refer to similar or like parts of the present disclosure. As used herein, the terms "first", "second" and "third" and the like are used interchangeably to distinguish one member from another and are not intended to denote the location or importance of individual members.

Embodiment 1

Figure 2:
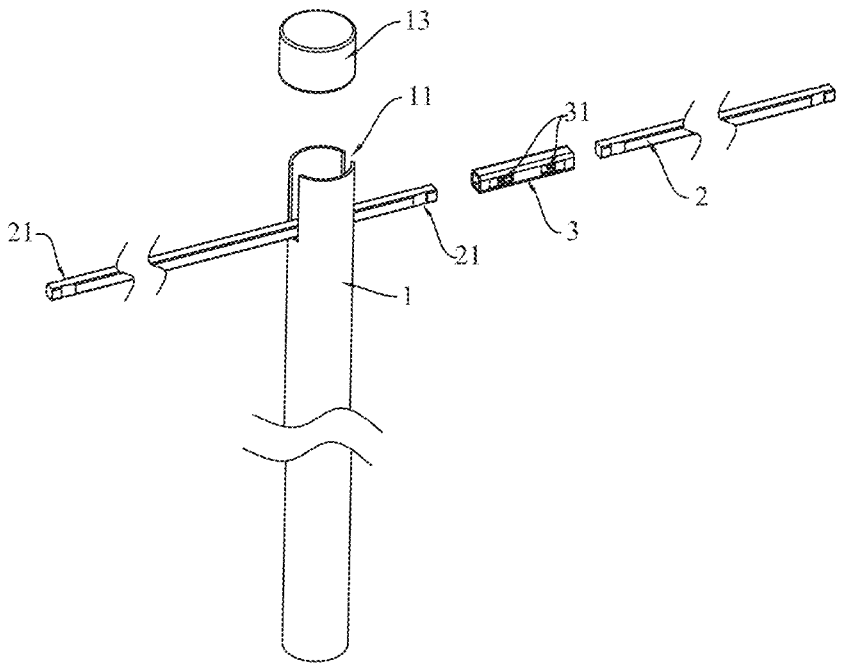
FIG. 2 is a schematic structural exploded view of a fence pole, a connecting strip, and a connecting piece in Embodiment 1.
Figure 3:
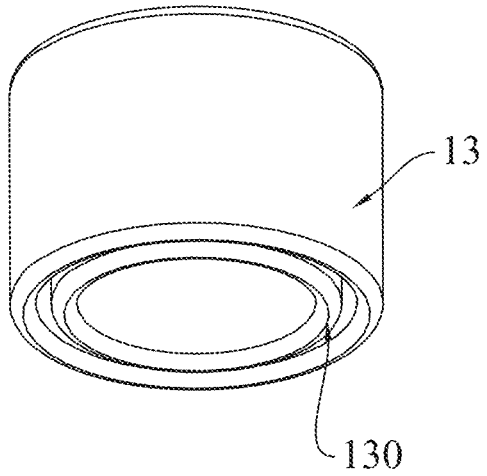
FIG. 3 is a schematic state diagram of showing a bottom structure by a cover cap of the fence pole in Embodiment 1.

As shown in FIGS. 1 to 3, according to an embodiment of the present disclosure, a support structure for a trampoline safety net is provided, including six fence poles 1, six connecting strips 2, and six connecting pieces 3 each configured to connect two connecting strips 2, where the six fence poles 1 are vertically mounted on side edges of a trampoline main body 5, and openings 11 are arranged at upper ends of the fence poles 1 and configured for limiting connection of the connecting strips 2. One connecting strip 2 is arranged between two adjacent fence poles 1, two adjacent connecting strips 2 are detachably connected by a corresponding connecting piece 3, heads and tails of all the connecting strips 2 are connected by the connecting strips 3 to form an annular structure, and the annular structure penetrates through the openings 11 at the upper ends of all the fence poles 1. In this case, edges of an upper end of a safety net can be connected by the annular structure to ensure that the edges do not collapse. Due to the arrangement of the openings 11 at the upper ends of the fence poles 1, the connecting strips 2, the connecting pieces 3, and the safety net can be mounted as a whole first and then enter the openings 11 from upper ends of the openings 11 of all the fence poles 1 in sequence.

Further, a width of the openings 11 is matched with a width of the connecting pieces 3, such that the connecting pieces 3 can be clamped on inner sides of the openings 11 after being connected to the connecting strips 2 to prevent the annular structure formed by the connecting strips 2 and the connecting pieces 3 from shaking greatly during use of the trampoline; moreover, it is possible to pre-clamp the connecting pieces 3 to the openings and then connect all the connecting strips 2 to the connecting pieces 3 in sequence, which facilitates the mounting and fixation of the safety net.

A specific connection between the connecting strips 2 and the connecting pieces 3 is as follows: each of the connecting pieces 3 is of a square tube structure, first limiting spring pieces 31 bent towards an inner side of a square tube are arranged on side walls of two ends of the connecting piece 3, respectively, each of the connecting strips 2 is of a square connecting strip structure, and a section size of the connecting strip 2 is matched with a section size of the inner side of the square tube of the connecting piece 3, such that when the connecting strip 2 is inserted into the connecting piece 3, the connecting strip 2 is in clearance fit with the connecting piece 3. Side surfaces of two ends of each connecting strip 2 correspond to side surfaces of the first limiting spring pieces 31 of each connecting piece 3 and are provided with clamping grooves 21, respectively, and the clamping grooves 21 are oblique straight grooves with right triangle sections, matched with the first limiting spring pieces 31. When the connecting strip 2 is inserted into the connecting piece 3, free ends of the first limiting spring pieces 31 abut against right-angle side surfaces of the clamping grooves 21. In this case, the first limiting spring pieces 31 can prevent the connecting strip 2 from moving along a direction opposite to an insertion direction.

Further, two first limiting spring pieces 31 are arranged on two opposite side walls of two ends of each connecting piece 3, respectively, and correspondingly, two clamping grooves 21 are arranged at positions, corresponding to two first limiting spring pieces 31 on each connecting piece 3, of end portions of each connecting strip 2, respectively, which facilitates the further connection and fixation between the connecting strip 2 and the connecting piece 3.

A top end of each fence pole 1 is further provided with a cover cap 13, the cover cap 13 covering the top end of the fence pole 1 and wrapping a tube wall of the fence pole 1 therein. A composite inner cover 130 is arranged inside the cover cap 13, the composite inner cover 130 being integrated with the cover cap 13 in design and having an outer diameter smaller than an inner diameter of the fence pole and an inner diameter greater than an outer diameter of the fence pole, and when the fence pole 1 is covered by the cover cap 13, the tube wall of the fence pole 1 is wrapped between the composite inner cover 130 and the cover cap 13, which increases the fixation strength of the tube wall of the fence pole 1.

Embodiment 2

Figure 4:
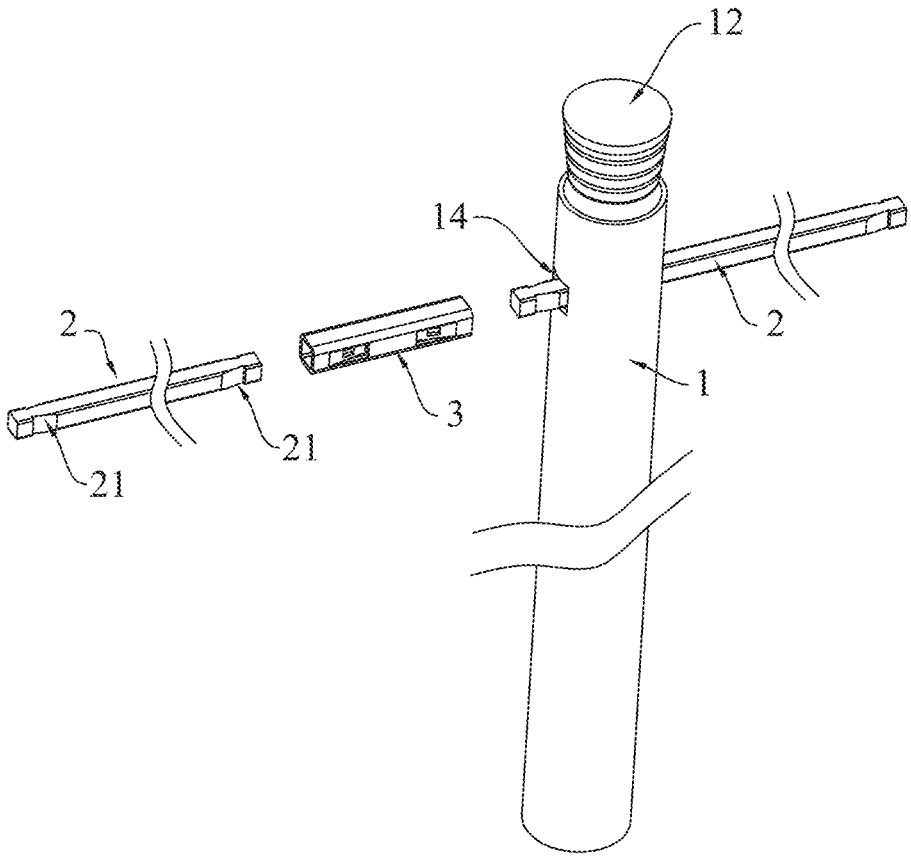
FIG. 4 is another schematic structural exploded view of a fence pole, a connecting strip, and a connecting piece in Embodiment 2.

This embodiment proposes another solution for the fence poles 1 based on Embodiment 1, which can also implement the limiting connection between the connecting strips 2 and the connecting pieces 3 at the top ends of the fence poles 1. A specific implementation is as follows: as shown in FIG. 4, a through hole 14 penetrating through each fence pole 1 along a radial direction is arranged at the top end of the fence pole 1, and a width of the through hole 14 is greater than a width of each connecting piece 3, such that the connecting piece 3 can be fixedly connected to one connecting strip 2 and then fixedly connect to another connecting strip 2 via the through hole 14. Alternatively, the width of the through hole 14 may be set to be greater than a width of each connecting strip 2 and less than the width of each connecting piece 3, such that the connecting strip 2 penetrates through the through hole 14 and then is fixedly connected to the connecting piece 3. The six connecting strips 2 penetrate through the through holes 14 of the corresponding fence poles 1, respectively, and then are connected by the connecting pieces 3 to form an annular structure. The top end of each fence pole 1 is covered by an inner plug 12 or a cover cap 13 to seal a top of the fence pole 1.

Embodiment 3

Figure 5:
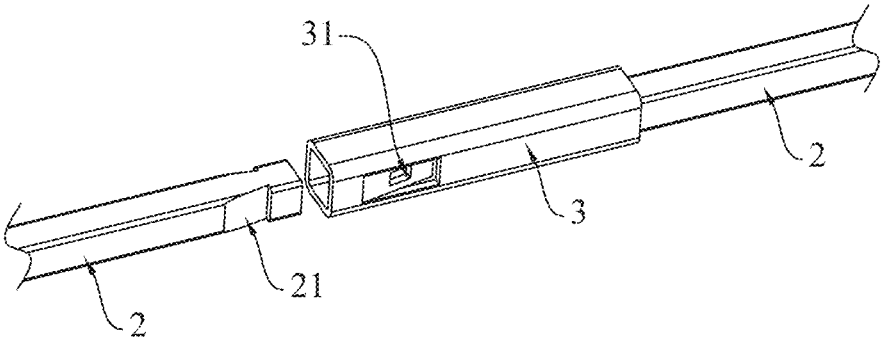
FIG. 5 is a schematic structural diagram of a connecting strip and a connecting piece in Embodiment 3.

The present disclosure further provides another connection between the connecting strips 2 and the connecting piece 3. A specific implementation is as follows: as shown in FIG. 5, a first limiting spring piece 31 is arranged at one end of each connecting piece 3, the other end of the connecting piece is welded to one end of each connecting strip 2 to form an integrated structure, and a clamping groove 21 matched with the first limiting spring piece 31 is arranged at the other end of the connecting strip 2. The connecting strips 2 penetrate through the corresponding fence poles 1, respectively, and heads and tails thereof are connected by the connecting pieces 3 to form an annular structure, which implements the fixed connection of the safety net. Compared with Embodiment 2, the connection between the connecting strips 2 and the connecting pieces 3 in this embodiment has fewer operation steps, which facilitates the mounting and fixation.

Embodiment 4

Figure 6:
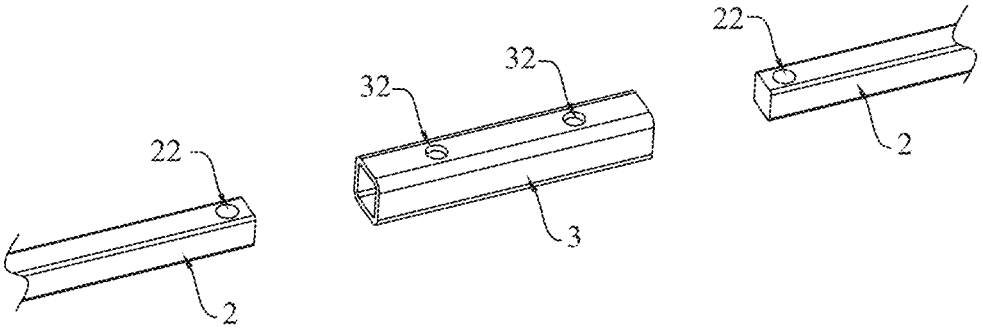
FIG. 6 is a schematic structural diagram of a connecting strip and a connecting piece in Embodiment 4.

The present disclosure further provides another connection between the connecting pieces 2 and the connecting strips 3. A specific implementation is as follows: as shown in FIG. 6, first connecting holes 32 are arranged at two ends of each connecting piece 3, respectively; correspondingly, second connecting holes 22 matched with the first connecting holes 32 are arranged at two ends of each connecting strip 2, respectively; and pins or bolts are arranged between the first connecting holes 32 and the second connecting holes 22 to fixedly connect the connecting strip to the connecting piece 3. The fixation by the bolts can facilitate the dismounting of the connecting strip 2 and the connecting piece 3.

Embodiment 5

Figure 7:
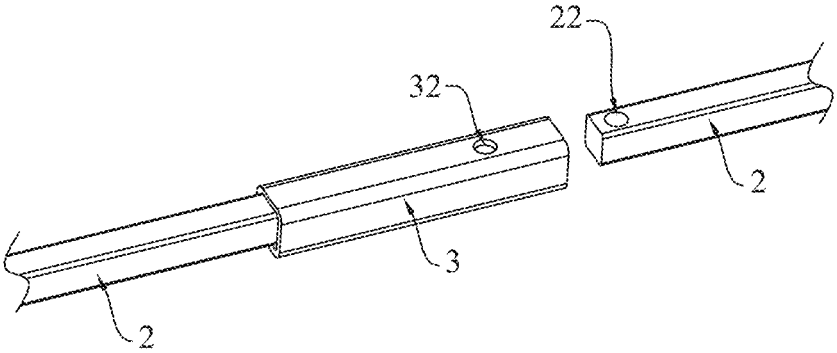
FIG. 7 is a schematic structural diagram of a connecting strip and a connecting piece in Embodiment 5.

The present disclosure further provides another connection between the connecting strips 2 and the connecting piece 3. A specific implementation is as follows: as shown in FIG. 7, a first connecting hole 32 is arranged at one end of each connecting piece 3, the other end of the connecting piece is welded to one end of each connecting strip 2 to form an integrated structure, and a second connecting hole 22 matched with the first connecting hole 32 is arranged at the other end of the connecting strip 2. The connecting strips 2 penetrate through the corresponding fence poles 1, respectively, and heads and tails thereof are connected by the connecting pieces 3 to form an annular structure, which implements the fixed connection of the safety net. The connecting strip 2 and the connecting piece 3 are fixed to form the integrated structure through welding which is not limited, and may alternatively be set to be integrated through bonding or casting, or other materials such as plastic materials are used and injection-molded to form the integrated structure, etc., which will not be listed all in this embodiment.

Embodiment 6

Figure 8:
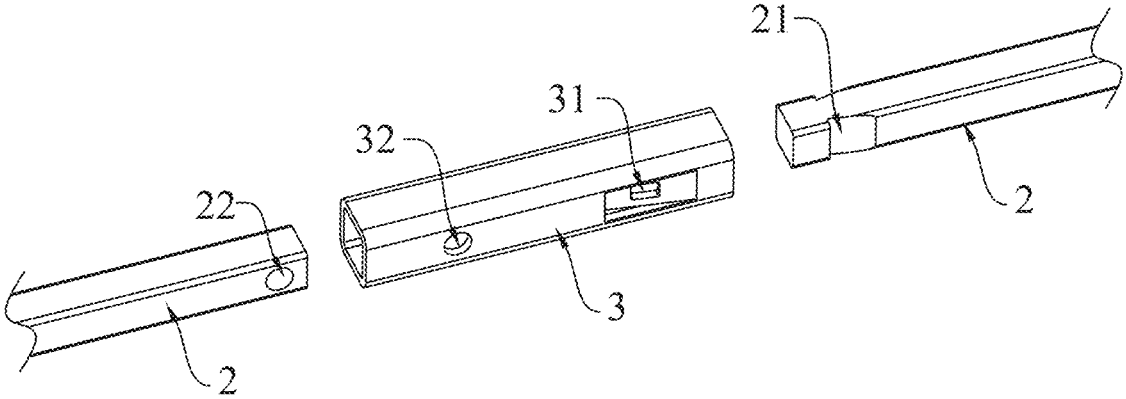
FIG. 8 is a schematic structural diagram of a connecting strip and a connecting piece in Embodiment 6.

The present disclosure further provides another connection between the connecting strips 2 and the connecting piece 3. A specific implementation is as follows: as shown in FIG. 8, a first limiting spring piece 31 is arranged at one end of each connecting piece 3, and a first connecting hole 32 is arranged at the other end of the connecting piece; and correspondingly, a clamping groove 21 matched with the first limiting spring piece 31 is arranged at one end of each connecting strip 2, and a second connecting hole 22 matched with the first connecting hole 32 is arranged at the other end of the connecting strip 2. The connecting strips 2 enable the clamping grooves 21 to correspond to the first limiting spring pieces 31, respectively, and the second connecting holes 22 and the first connecting holes 32 correspondingly penetrate through the corresponding fence poles 1 and connect heads and tails thereof to form an annular structure, which implements the fixed connection of the safety net.

Embodiment 7

Figure 9:
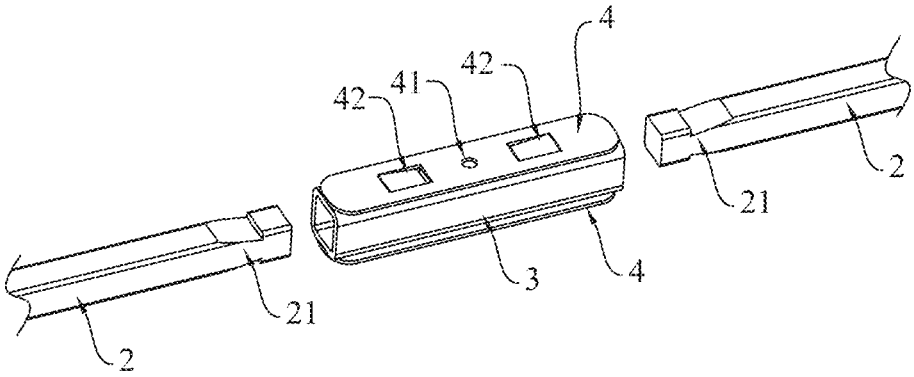
FIG. 9 is a schematic structural diagram of a connecting strip and a connecting piece in Embodiment 7.
Figure 10:
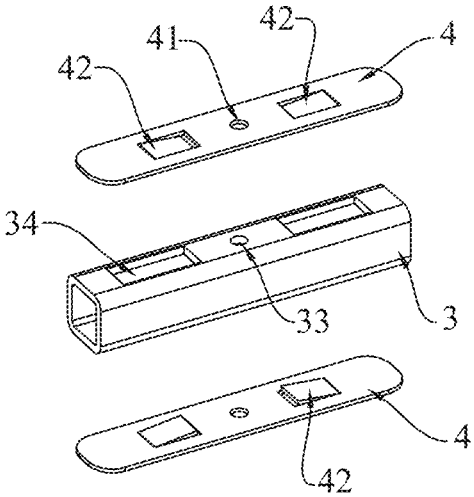
FIG. 10 is a schematic structural exploded view of the connecting piece in Embodiment 7.

In Embodiment 1, the first limiting spring pieces 31 of the connecting pieces 3 are integrated with the connecting pieces 3 in design. Under the condition that the rigidity of bodies of connecting pieces 3 is maintained to meet the strength requirements, the elasticity of the first limiting spring pieces 31 is poor, and the first limiting spring pieces 31 are prone to breakage after being dismounted for multiple times. Therefore, as shown in FIG. 9 and FIG. 10, the present disclosure further provides another connection between the connecting strips 2 and the connecting pieces 3. A specific implementation is as follows: communicating grooves 34 are arranged at two ends of each connecting piece 3, respectively, and penetrate through two opposite side surfaces of the connecting piece 3, first mounting holes 33 are further arranged on the two side surfaces of the connecting piece 3, spring plates 4 are further arranged on two sides of the connecting piece 3, second mounting holes 41 are arranged at positions, corresponding to the first mounting holes 33, of the spring plates 4, and bolts or pins are arranged in the first mounting holes 33 and the second mounting holes 41 to fixedly connect the spring plates 4 to the connecting piece 3. Second limiting spring pieces 42 are arranged at positions, corresponding to the two communicating grooves 34, of the spring plates 4, clamping grooves 21 matched with the second limiting spring pieces 42 are arranged at two ends of each of the connecting strips 2, respectively, and the second limiting spring pieces 42 extend into the communicating grooves 34 and cooperate with the clamping grooves 21 to clamp the connecting strip 2. The spring plates 4 are made of a material with higher elasticity, which can be conveniently bent for multiple times and facilitates the connecting strip 2 and the connecting piece 3 to be dismounted, mounted and used for multiple times.

Embodiment 8

Figure 11:
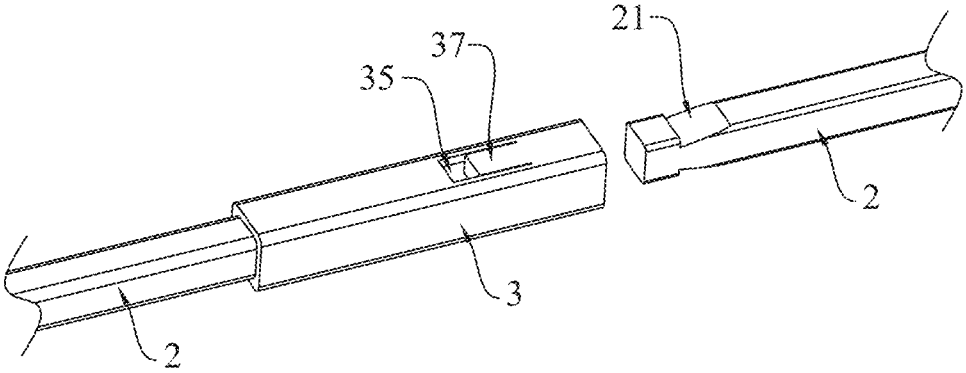
FIG. 11 is a schematic structural exploded view of a connecting piece in Embodiment 8.
Figure 12:
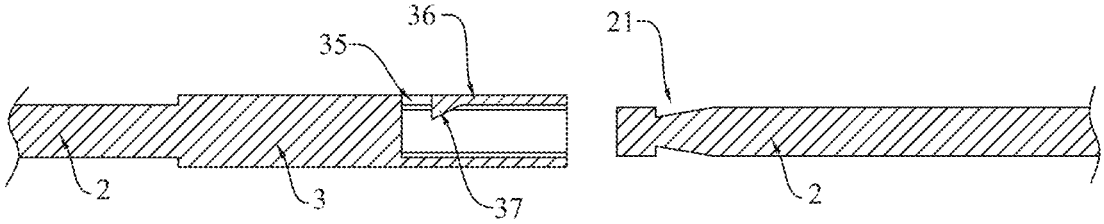
FIG. 12 is a schematic structural exploded view of the connecting piece in Embodiment 8.

The present disclosure further provides another connection between the connecting strips 2 and the connecting pieces 3. A specific implementation is as follows: as shown in FIGS. 11-12, a dismounting hole 35 is arranged at one end of each connecting piece 3, a clamping plate 36 with one fixed end is arranged in the dismounting hole 35, a clamping key 37 is arranged on an inner side of a free end of the clamping plate 36, correspondingly, a clamping groove 21 matched with the clamping key 37 is arranged at one end of each connecting strip 2, and the other end of the connecting piece 3 is welded to one end of the connecting strip 2 to form an integrated structure. Combinations of the connecting pieces 3 and the connecting strips 2 are connected end to end in sequence to form an annular shape. Further, a size of the clamping plate 36 is smaller than a size of the dismounting hole 35, which facilitates an operator to use a tool to extend into the dismounting hole 35 and then lift up the free end of the clamping plate 36 to remove the clamped connection between the clamping key 37 and the clamping groove 21, so as to implement dismounting as a whole.

From the above description, it can be seen that the above embodiment of the present disclosure achieves the following technical effects:

1. The openings 11 are arranged at the upper ends of the fence poles 1, which can facilitate the plurality of connecting strips 2 and the corresponding connecting pieces 3 to be connected end to end to form the annular structure and then to be mounted above the fence poles 1. Alternatively, the connecting strips 2 and the connecting pieces 3 penetrate through the corresponding openings 11 in sequence and then are connected to form the annular structure, such that the safety net can be conveniently connected to the connecting strips 2 and the connecting pieces 3 to form a whole and then is fixedly mounted on the fence poles 1, or can be mounted on the fence poles 1 along with the connecting strips 2 and the connecting pieces 3 in sequence.
2. The width of the openings 11 or the through holes 14 of the fence poles 1 is set to be matched with the width of the connecting pieces 3, which facilitates the connecting pieces 3 to be hidden and limited in the openings 11. During use, the annular structure formed by the connecting strips 2 and the connecting pieces 3 can be prevented from shaking greatly.

3. The first limiting spring pieces 31 are arranged on two ends of each connecting piece 3, the clamping grooves 21 matched with the first limiting spring pieces 31 are arranged at two ends of each connecting strip 2, and when the connecting strip 2 is inserted into the connecting piece 3, the first limiting spring pieces 31 cooperate with the clamping grooves 21 to clamp the connecting strip 2 and the connecting piece 3, making the connection more convenient.
4. The first limiting spring piece 31 is arranged at one end of each connecting piece 3, and the other end of the connecting piece is welded to one end of each connecting strip 2 to form the integrated structure, which can reduce and shorten the steps and time for the connection process.
5. The first connecting holes 32 are arranged at two ends of each connecting piece 3, the second connecting holes 22 matched with the first connecting holes 32 are arranged at two ends of each connecting strip 2, respectively, and the pins or the bolts are arranged between the first connecting holes 32 and the second connecting holes 22 to fixedly connect the connecting strip to the connecting piece 3, such that the pins or the bolts can be conveniently removed to dismount the safety net of the trampoline.
6. The first limiting spring piece 31 is arranged at one end of each connecting piece 3, the first connecting hole 32 is arranged at the other end of the connecting piece, the clamping groove 21 matched with the first limiting spring piece 31 is arranged at one end of each connecting strip 2, and the second connecting hole 22 matched with the first connecting hole 32 is arranged at the other end of the connecting strip 2, such that the connecting piece 3 and the connecting strip 2 can be conveniently connected or dismounted.
7. The connecting pieces 3 cooperate with the spring plates 4 to fixedly connect the connecting strips 2. The communicating grooves 34 are arranged at two ends of each connecting piece 3, respectively, the second limiting spring pieces 42 are arranged at the positions, corresponding to the communicating grooves 34, of the spring plates 4, the clamping grooves 21 matched with the second limiting spring pieces 42 are arranged at two ends of each connecting strip 2, respectively, and the second limiting spring pieces 42 extend into the communicating grooves 34 and cooperate with the clamping grooves 21 to clamp the connecting strip 2. The spring plates 4 are made of a material with higher elasticity, which can be conveniently bent for multiple times and facilitates the connecting strip 2 and the connecting piece 3 to be dismounted, mounted and used for multiple times.

Compared with the prior art, the support structure for the trampoline safety net according to the present invention is simple and convenient to mount, and edges of the safety net will not collapse.

The foregoing is merely a preferred embodiment of the present disclosure and is not intended to limit the present disclosure which may be subject to various modifications and variations to those skilled in the art. Any modification, equivalent replacement, improvement, etc. made within the spirit and principles of the present disclosure should be included in the scope of protection of the present disclosure.

What is claimed is:

1. A support structure for a trampoline safety net, comprising:

a plurality of fence poles, arranged vertically upwards and at intervals, wherein a bottom of each of the plurality of fence poles is mounted on an edge of a trampoline main body;

a plurality of connecting strips, configured to penetrate through the plurality of fence poles along a direction perpendicular to a longitudinal direction of the plurality of fence poles, wherein the plurality of fence poles are configured to restrict the movement of the plurality of connecting strips; and at least one connecting piece, each of the at least one connecting piece fixedly connecting adjacent two of the plurality of connecting strips;

wherein two communicating grooves are arranged at each of two side surfaces of each of the at least one connecting piece, respectively, two spring plates are mounted on each of the two side surfaces of each of the at least one connecting piece, two second limiting spring pieces are arranged at positions, corresponding to the two communicating grooves, of each of the two spring plates, two clamping grooves matched with two corresponding second limiting spring pieces are arranged at two ends of each of the plurality of connecting strips, respectively, and the second limiting spring pieces extend into the communicating grooves and cooperate with the clamping grooves to clamp adjacent two of the plurality of connecting strips.

2. The support structure for the trampoline safety net according to claim 1, wherein a first mounting hole is arranged on each of the two side surfaces of each of the at least one connecting piece, a second mounting hole is arranged at a corresponding spring plate, and a pin or a bolt is arranged in the first mounting hole and the second mounting hole to fixedly connect each of the two spring plates to a corresponding connecting piece.

3. A support structure for a trampoline safety net, comprising:

a plurality of fence poles, arranged vertically upwards and at intervals, wherein a bottom of each of the plurality of fence poles is mounted on an edge of a trampoline main body;

a plurality of connecting strips, configured to penetrate through the plurality of fence poles along a direction perpendicular to a longitudinal direction of the plurality of fence poles, wherein the plurality of fence poles are configured to restrict the movement of the plurality of connecting strips; and at least one connecting piece, each of the at least one connecting piece fixedly connecting adjacent two of the plurality of connecting strips;

wherein a dismounting hole is arranged at a first end of each of the at least one connecting piece, a clamping plate with one fixed end is arranged inside the dismounting hole, a clamping key is arranged on an inner side of a free end of the clamping plate, correspondingly, a clamping groove matched with the clamping key is arranged at a proximal end of each of the plurality of connecting strips, and a size of the dismounting hole is greater than a size of the clamping plate, which facilitates an operator to use a tool to extend into the dismounting hole and then lift up the free end of the clamping plate to remove the clamped connection between the clamping key and the clamping groove; and a second end of each of the plurality of connecting pieces is fixed to a distal end of a corresponding connecting strip to form an integrated structure.

* * * * *